US011814147B2

(12) United States Patent
Torzy et al.

(10) Patent No.: US 11,814,147 B2
(45) **Date of Patent: *Nov. 14, 2023**

(54) BOAT WITH A WATER MAT

(71) Applicant: Crest Marine LLC, Owosso, MI (US)

(72) Inventors: Shane M. Torzy, Linden, MI (US); Kevin L. Huff, Owosso, MI (US)

(73) Assignee: Crest Marine LLC, Owosso, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,485

(22) Filed: May 23, 2022

(65) Prior Publication Data

US 2022/0281575 A1 Sep. 8, 2022

Related U.S. Application Data

(63) Continuation of application No. 17/031,278, filed on Sep. 24, 2020, now Pat. No. 11,364,983.

(60) Provisional application No. 62/904,845, filed on Sep. 24, 2019.

(51) Int. Cl.

| | |
|---|---|
| ***B63C 13/00*** | (2006.01) |
| *B63B 1/14* | (2006.01) |
| *B63B 29/02* | (2006.01) |

(52) U.S. Cl.

CPC ..... *B63C 13/00* (2013.01); *B63B 2001/145* (2013.01); *B63B 2029/022* (2013.01)

(58) Field of Classification Search

CPC ..... B63C 13/00; B63B 2001/145; B63B 2029/022

See application file for complete search history.

(56) References Cited

U.S. PATENT DOCUMENTS

| | | | | |
|---|---|---|---|---|
| 4,372,243 | A * | 2/1983 | Roope, Jr. | B63B 17/00 114/364 |
| 5,113,791 | A * | 5/1992 | Rottschafer | B63H 20/36 248/642 |
| 7,900,575 | B2 | 3/2011 | Walbridge et al. | |
| 8,028,641 | B1 | 10/2011 | Sly | |
| 8,375,880 | B1 | 2/2013 | St. Clair, Jr. et al. | |
| 9,278,731 | B1 * | 3/2016 | Canela | B63B 7/08 |
| 9,340,258 | B1 | 5/2016 | Long | |
| 9,475,554 | B2 | 10/2016 | Heimerl | |

(Continued)

FOREIGN PATENT DOCUMENTS

WO 2005/117655 A1 12/2005

OTHER PUBLICATIONS

About Aqua Lily Floating Foam Pads; https://aqualilypad.com/about/ (last visited Sep. 17, 2019).

(Continued)

*Primary Examiner* — S. Joseph Morano
*Assistant Examiner* — Jovon E Hayes
(74) *Attorney, Agent, or Firm* — Venable LLP

(57) ABSTRACT

A water mat for a boat and a boat. The boat may be a pontoon boat. The water mat may include a cut-out. The cut-out may be formed in a forward side of the water mat, with the forward side of the water mat is connected to the stern of the boat such that the outboard motor is positioned in the cut-out of the water mat. A flexible connecting sheet, that is configured to connect the water mat with the boat, may be attached to a connection side of the water mat and extend along the connection side of the water mat.

20 Claims, 13 Drawing Sheets

(56) References Cited

U.S. PATENT DOCUMENTS

| | | | | |
|---|---|---|---|---|
| 9,487,273 | B1 * | 11/2016 | Eekhoff | B63B 29/04 |
| 9,586,655 | B1 * | 3/2017 | Butler | B63B 17/00 |
| 9,937,979 | B1 | 4/2018 | Holmes | |
| 10,392,084 | B2 * | 8/2019 | Wood | B63B 32/51 |
| 10,399,645 | B1 | 9/2019 | Holmes | |
| 10,479,454 | B2 | 11/2019 | Barwick | |
| 10,668,991 | B1 * | 6/2020 | Champlin | B63B 29/00 |
| 2016/0159437 | A1 | 6/2016 | Pappas et al. | |
| 2021/0086885 | A1 * | 3/2021 | Torzy | B63C 13/00 |

OTHER PUBLICATIONS

FlexCore Technology Advantage—Aqua Lily; https://aqualilypad.com/flexcore-technology-advantage/ (last visited Sep. 17, 2019).

Lake Travis Boat Rentals—Float On; Apr. 9, 2018; https://rentalboataustin.com/lake-travis-boat-rentals/ (last visited Sep. 18, 2019).

REEF Inflatable Water Mats; https://www.missionboatgear.com/products/inflatable-reef-mat (last visited Sep. 17, 2019).

* cited by examiner

BOAT WITH A WATER MAT

CROSS-REFERENCE TO RELATED APPLICATIONS

This application is a continuation of U.S. patent application Ser. No. 17/031,278, filed Sep. 24, 2020. U.S. patent application Ser. No. 17/031,278 claims the benefit under 35 U.S.C. § 119(e) of U.S. Provisional Patent Application No. 62/904,845, filed Sep. 24, 2019, and titled "BOAT WITH AN INFLATABLE MAT." The foregoing applications are hereby incorporated by reference in their entireties and are made a part of this specification for all that they disclose.

FIELD OF THE INVENTION

This invention relates to a boat having an inflatable mat, in particular, a pontoon boat having an inflatable mat that can be conveniently deployed and stowed.

BACKGROUND OF THE INVENTION

Water mats, which are also known as, water pads, lily pads, or floating islands, are mats that float on the surface of a body of water, such as a pond, lake, or river, and can support one or more persons. Water mats are typically large rectangular mats that may have a width of 6 feet and a length longer than 6 feet, such as, for example, 12 feet, 15 feet, or 18 feet. With such a large buoyant area, these mats have a capacity to hold a substantial amount of weight and can suitably hold multiple people at once, such as, for example, four, six, or eight adults, respectively. These water mats may be rolled up from their flat, rectangular deployed position in order to be stowed. As water mats are commonly made of a foam material, these mats, however, can be difficult to roll up and stow aboard a boat, particularly when wet.

SUMMARY OF THE INVENTION

The invention relates, in various aspects, to boats and water mats for boats.

In one aspect, the invention relates to a boat. The boat includes a stern, an outboard motor attached to the stern, and a water mat. The water mat has a forward side and includes a cut-out formed in the forward side of the water mat. The forward side of the water mat is connected to the stern of the boat such that the outboard motor is positioned in the cut-out of the water mat.

In another aspect, the invention relates to a water mat system. The water mat system includes a water mat and a flexible connecting sheet. The water mat has a connection side capable of being positioned proximate a boat. The flexible connecting sheet is configured to connect the water mat with the boat. The connecting sheet is attached to the connection side of the water mat and extends along the connection side of the water mat.

In a further aspect, the invention relates to a pontoon boat. The pontoon boat includes a port-side pontoon, a starboard-side pontoon, a deck supported by the port-side pontoon and the starboard-side pontoon, and a water mat connected to the deck. The water mat has (i) a top surface, (ii) a bottom surface, (iii) an outer lateral surface and (iv) a cut-out formed in the water mat. The outer latter surface forms an outer perimeter of the water mat.

These and other aspects of the invention will become apparent from the following disclosure.

DETAILED DESCRIPTION OF THE PREFERRED EMBODIMENTS

Figure 1:
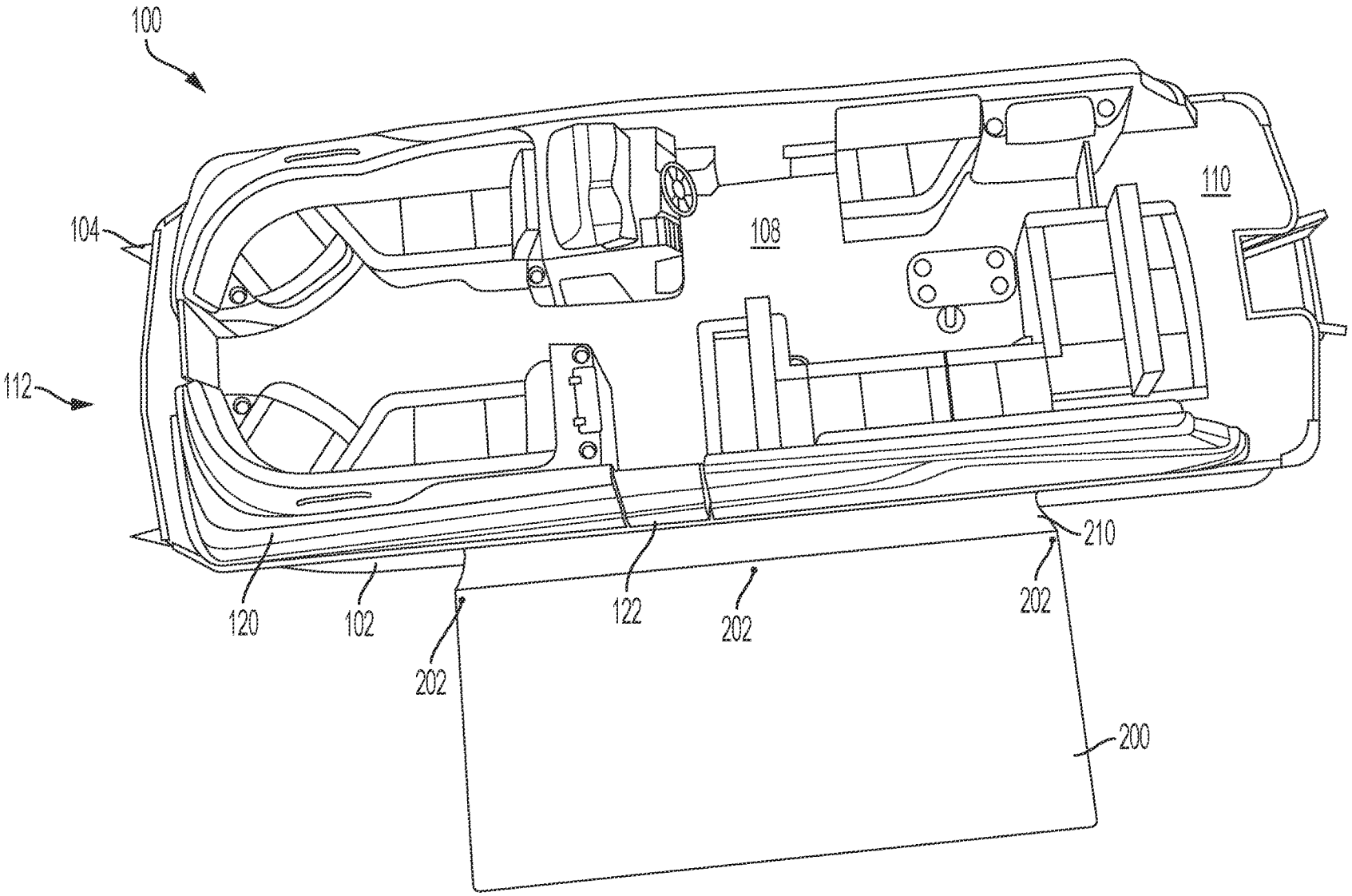
FIG. 1 shows a boat equipped with an inflatable mat according to a preferred embodiment of the invention.

FIG. 1 shows a boat 100 equipped with an inflatable mat 200 according to a preferred embodiment of the invention. In this embodiment, the boat 100 is a pontoon boat having at least a port-side pontoon 102 and a starboard-side pontoon 104. Although the invention is described in conjunction with a pontoon boat, it is not so limited, and the invention may be used with any suitable boat. The port-side pontoon 102 and the starboard-side pontoon 104 are oriented in a longitudinal direction of the boat 100, which extends in a fore and aft direction of the boat 100. A plurality of cross beams 106 (see FIGS. 2 and 3) are connected to an upper side of each of the port-side pontoon 102 and the starboard-side pontoon 104 in a direction transverse to the longitudinal direction of the boat 100, which in this embodiment is a port and starboard direction of the boat 100. The cross beams 106 support a deck 108 of the boat 100.

The boat 100 also includes a fence 120 mounted to the deck 108 around the perimeter of the deck 108. The fence 120 of this embodiment may include a plurality of gates, including, for example, a port-side gate 122. The gates open and close to allow passengers to enter and exit the inside of the boat 100.

The boat 100 is equipped with at least one water mat 200. In this embodiment, the water mat 200 is an inflatable mat 200. A suitable inflatable mat 200 can be, for example, a REEF inflatable mat made by Mission Boat Gear of Plymouth, Minn. The inflatable mat 200 is suitably designed to support multiple individuals stably on the water. Preferably the inflatable mat 200 has a surface that contacts the water, which in this embodiment is the bottom surface of the inflatable mat 200. Buoyant forces act on this surface to support the weight of individuals on the inflatable mat 200, and preferably, the surface area of the water contacting surface is 20 square feet or greater, more preferably 36 square feet or greater, and even more preferably 75 square feet or greater. In the embodiment shown in FIGS. 1-3 for example the inflatable mat 200 may be 13 feet long and 6.5 feet wide giving the boater just over 84 square feet of usage. The amount of air inside the inflatable mat 200 may also impact its buoyancy. The inflatable mat 200 is preferably at least two inches thick and preferably less than a foot thick. Preferable thicknesses include four inches, six inches, or even ten inches. The inflatable mat 200 is preferably designed to be a surface used when the boat 100 is anchored, beached, or otherwise not being propelled through the water. Alternatively, the inflatable mat 200 can be designed for use when the boat is underway, provided necessary precautions are taken to ensure that persons aboard the inflatable mat 200 do not come into contact with the boat's propeller and the connections between the boat 100 and the inflatable mat 200 are strong enough to support the loads while underway. The inflatable mat 200 can be readily inflated and deflated to be stored on the boat 100 when not in use. The preferred embodiment of the invention uses an inflatable mat 200 as it is easy to deploy and stow. Such an inflatable mat 200 also is relatively stable on the water and thus suitable for use in close proximity to the boat 100. However, other suitable mats, such as foam mats, may be used in place of the inflatable mat 200 discussed herein. When the foam mat is used as the water mat, it may also have the preferred surface areas discussed herein.

When an inflatable mat 200 is used, the inflatable mat 200 may be inflated and deflated using a pump, such as an electrical air pump. The pump may suitably engage with a port on the inflatable mat 200 and drive air into or out of the inside of the inflatable mat 200 to inflate or deflate, respectively, the inflatable mat 200. The pump may be a component of the boat 100 and connected to the electrical system of the boat 100. When deflated, the inflatable mat 200 can be stored in or on the boat 100. The boat 100 may include a compartment 124 to store the inflatable mat 200. In this embodiment, the compartment 124 is an elongated compartment 124 located in the fence 120 on the port side of the boat and aft of the port-side gate 122 (see FIGS. 6 and 7). An outboard portion of the fence 120 may be a hatch 126 that can be opened and closed to allow access to the compartment 124. The compartment 124 may be located at any suitable location on the boat 100 including underneath the deck 108. The inflatable mat 200 may be stored such as by being folded, gathered, or rolled after the air has been removed from the inside of the inflatable mat 200. When rolled, a reel may be used. Such a reel may be positioned under the deck 108, for example, near where the connecting sheet 210, which is discussed below, is attached to the deck 108. Such a reel may be powered by an electronic motor or the like to wind the inflatable mat 200 after it has been deflated. Such a reel may also be located on the underside of the deck 108 between the port-side pontoon 102 and the starboard-side pontoon 104 when the inflatable mat 200 is connected to the bow 112 or stern deck 110, as discussed further below.

The inflatable mat 200 is designed to be connected to the boat 100. As shown in FIG. 1, the inflatable mat 200 is shown connected to the port side of the boat 100. The inflatable mat 200, however, may be suitably connected at any other location on the boat 100 including, for example, the starboard side of the boat 100; off the stern, such as at a stern deck 110, which is integrally formed with the deck 108 in this embodiment; or off the bow 112 of the boat 100. Another embodiment in which the inflatable mat 200 is shown attached to the stern of the boat 100 will be discussed further below with reference to FIGS. 8-10. Although in the preferred embodiment shown one inflatable mat 200 is provided, multiple inflatable mats can be provided at different locations around the boat 100.

Figure 2:
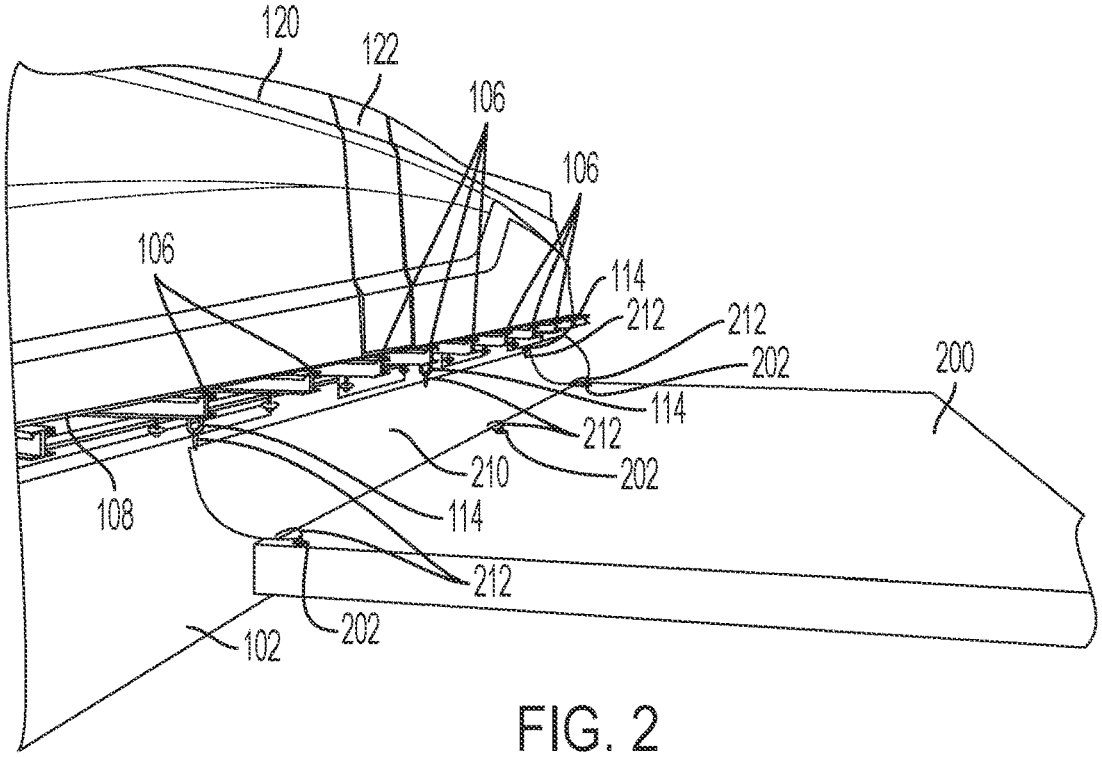
FIG. 2 is a perspective view of the boat shown in FIG. 1 showing the inflatable mat attached to the port side of the boat.
Figure 3:
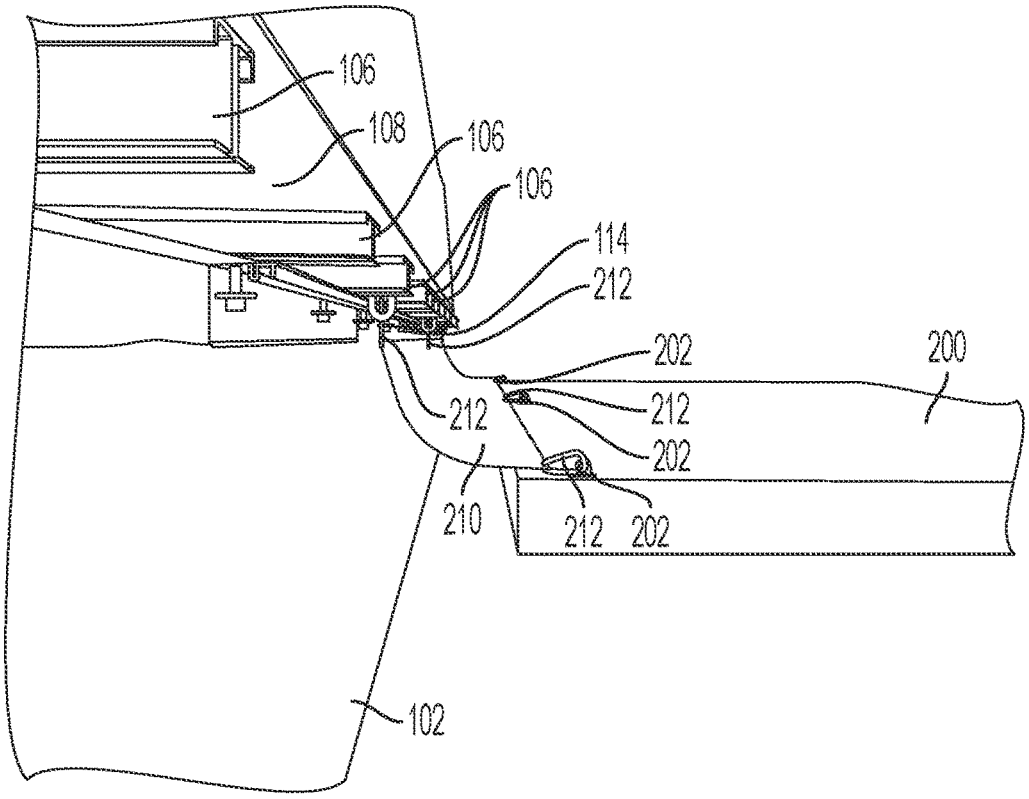
FIG. 3 is view of the boat shown in FIG. 1 taken along the port side of the boat looking fore to aft.

The inflatable mat 200 is connected to the boat 100 by a connecting sheet 210. Details of the connecting sheet 210 are best seen in FIGS. 2 and 3. The connecting sheet 210 may be made of any material suitable for outdoor use in a marine environment and that has appropriate gauge (or thickness) and strength to keep the inflatable mat 200 connected to the boat 100 when loads from use are imparted to the inflatable mat 200. Such loads may include, for example, multiple individuals jumping onto or off the inflatable mat 200 at once.

The connecting sheet 210 is preferably long enough to allow the entirety of the inflatable mat 200 to float on the water but short enough to keep the inflatable mat 200 close to the boat 100. Preferably, the inflatable mat 200 is close enough to the boat 100 that an adult walking through a port-side gate 122 could comfortably step (e.g., with a normal gate) onto the inflatable mat 200 from the deck 108. The boat 100 has a distance between the deck 108 and the waterline when the boat 100 is at rest, and preferably the connecting sheet 210 is longer than the distance between the deck 108 and the waterline. The connecting sheet 210 not only connects the inflatable mat 200 to the boat 100 to prevent the inflatable mat 200 from floating away from the boat 100, but the connecting sheet 210 also provides a barrier to prevent people or objects from falling between the port-side pontoon 102 and the inflatable mat 200.

Although the connecting sheet 210 may be integrally formed with the inflatable mat 200, the inflatable mat 200 of this embodiment is detachably connected to the connecting sheet 210 by a plurality of detachable links 212. Although any suitable detachable connection may be used, the detachable link 212 of this embodiment is a spring link or carabiner. The connecting sheet 210 includes a plurality of holes 214 along an outboard edge of the connecting sheet 210. The holes 214 may be reinforced with a grommet. Each detachable link 212 is placed in a corresponding one of the plurality of holes 214. The inflatable mat 200 includes a plurality of tie offs 202 formed along at least one side of the inflatable mat 200. Each detachable link 212 is also attached to a D-ring of each of the tie offs 202.

Figure 4:
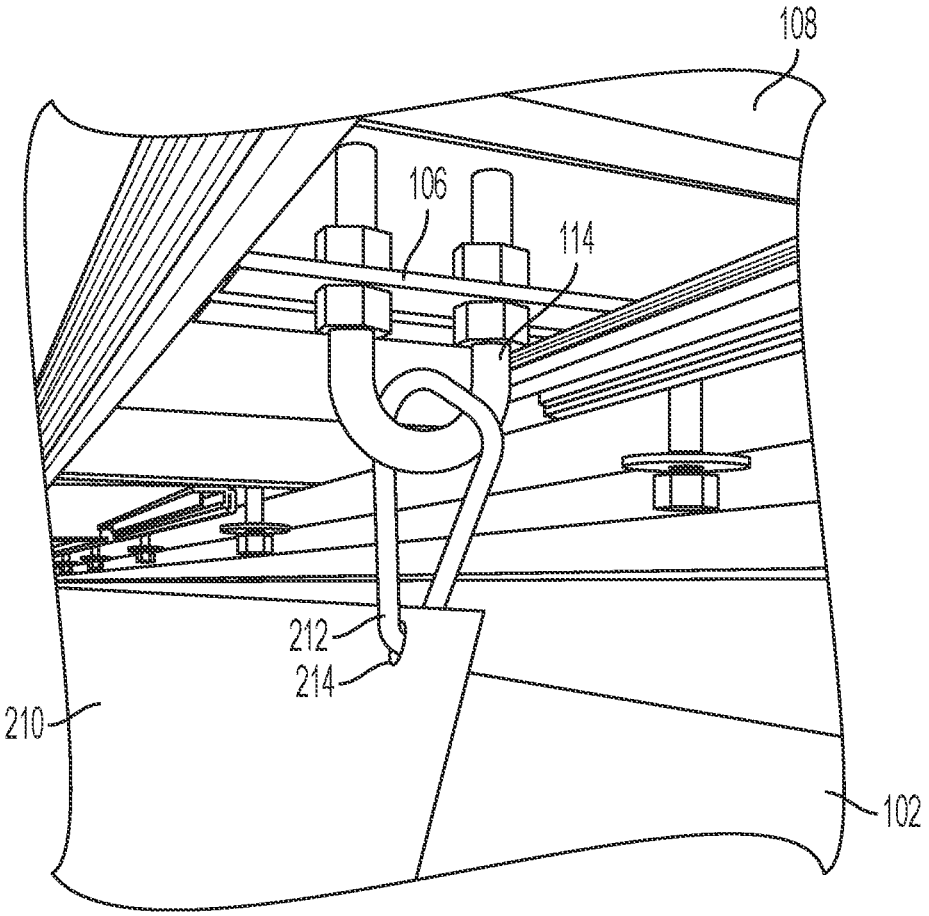
FIG. 4 is a detail view of an aft-most connecting link.

The inboard side of the connecting sheet 210 also includes a plurality of holes 214 to which a detachable link 212 is also attached. FIG. 4 is a detail view of the aft-most detachable link 212. The plurality of detachable links 212 on the inboard side of the connecting sheet 210 are used to detachably connect the connecting sheet 210 to the boat 100. In this embodiment, a U-shaped ring 114 is attached to the underside of a plurality of cross beams 106. The U-shaped ring 114 may, however, be connected to other portions of the boat 100, including, for example, the underside of the deck 108. The connection to the boat 100 is preferably located such that the connecting sheet 210 is high enough to minimize gaps that would allow objects to fall between the inflatable mat 200 and the boat 100. The U-shaped ring 114 shown in FIG. 4 is a U-bolt in this embodiment, but any suitable connection which interfaces with the detachable link 212 may be used. Other suitable connections may be used to connect the connecting sheet 210 to the boat 100 and, particularly, to the deck 108.

Figure 5:
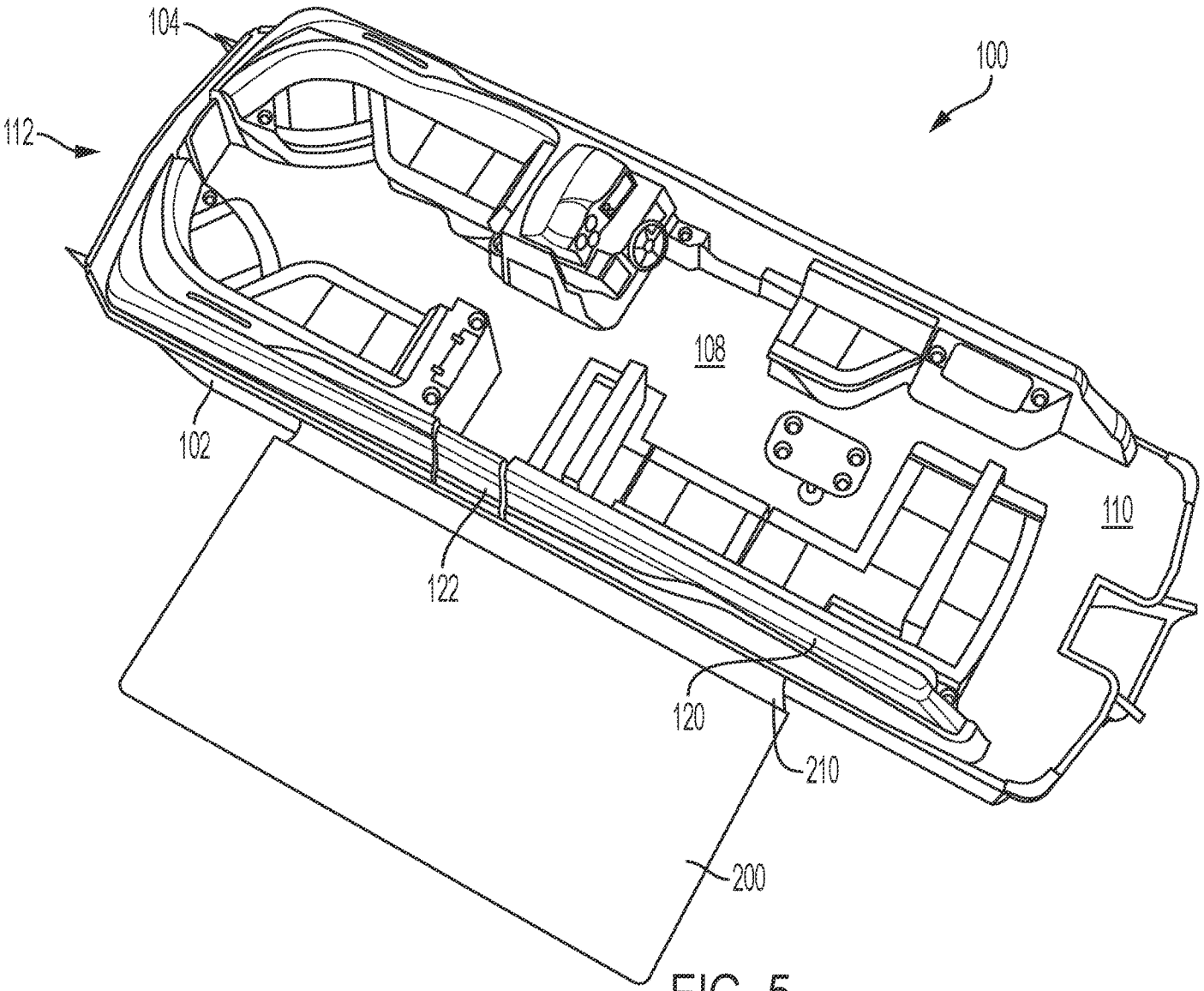
FIG. 5 shows a boat equipped with an inflatable mat according to another preferred embodiment of the invention.
Figure 6:
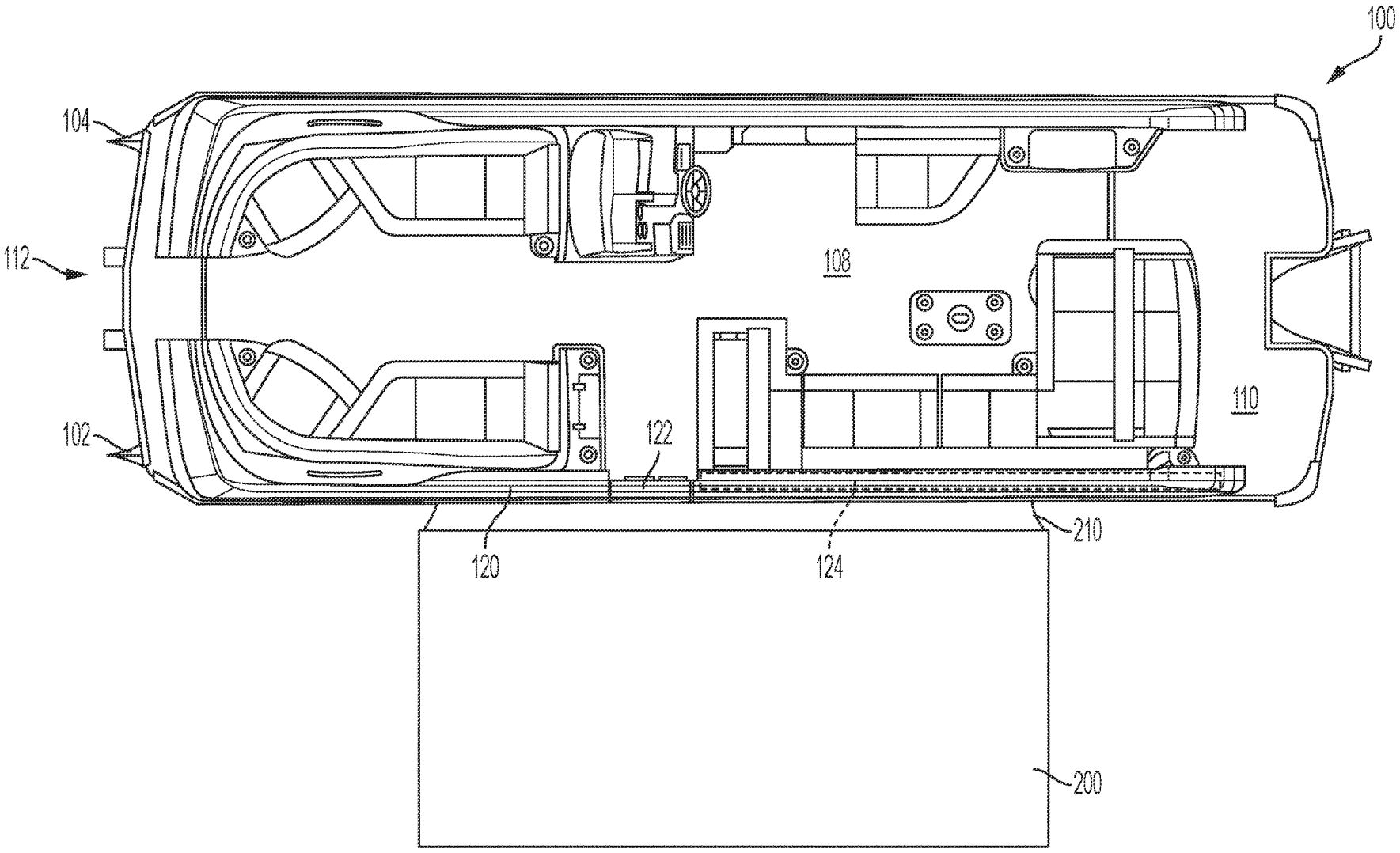
FIG. 6 is a top view of the boat and inflatable mat shown in FIG. 5.
Figure 7:
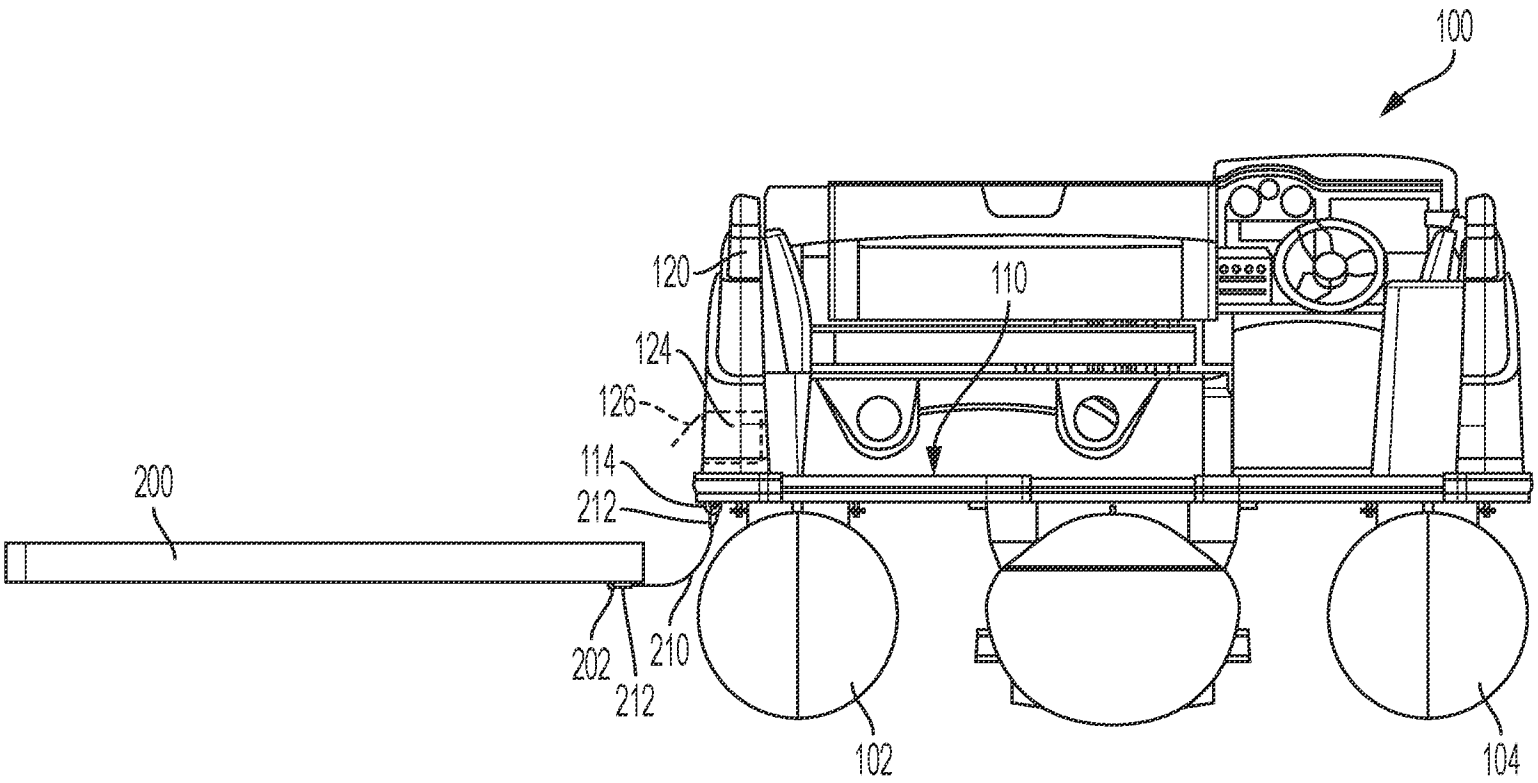
FIG. 7 is an aft view of the boat and inflatable mat shown in FIG. 5.

In the embodiment shown in FIGS. 1-3, the connecting sheet 210 is attached to the inflatable mat 200 on an upper surface of the inflatable mat 200. The invention, however, is not so limited. Alternatively, the connecting sheet 210 may be attached to the inflatable mat 200 at other suitable locations, including, for example, the underside surface of the inflatable mat 200 as shown in FIGS. 5-7. Attaching the connecting sheet 210 on the underside of the inflatable mat 200 enables the attachment, such as the tie off 202 and detachable link 212, to be located at a position away from where it could be readily contacted by a person's foot, for example. Because this orientation inhibits a person striking or getting scratched by the attachment, other types of attachment mechanisms may suitably be used. For example, an adjustable strap may be located between the detachable link 212 and the tie off 202. Such adjustable straps may include a buckle that allows the length of the strap to be changed. This configuration may allow the entirety of the inflatable mat 200 to remain floating on the water even when the boat 100 has different loading configurations, such as when the bow is farther out of the water than the stern.

Figure 8:
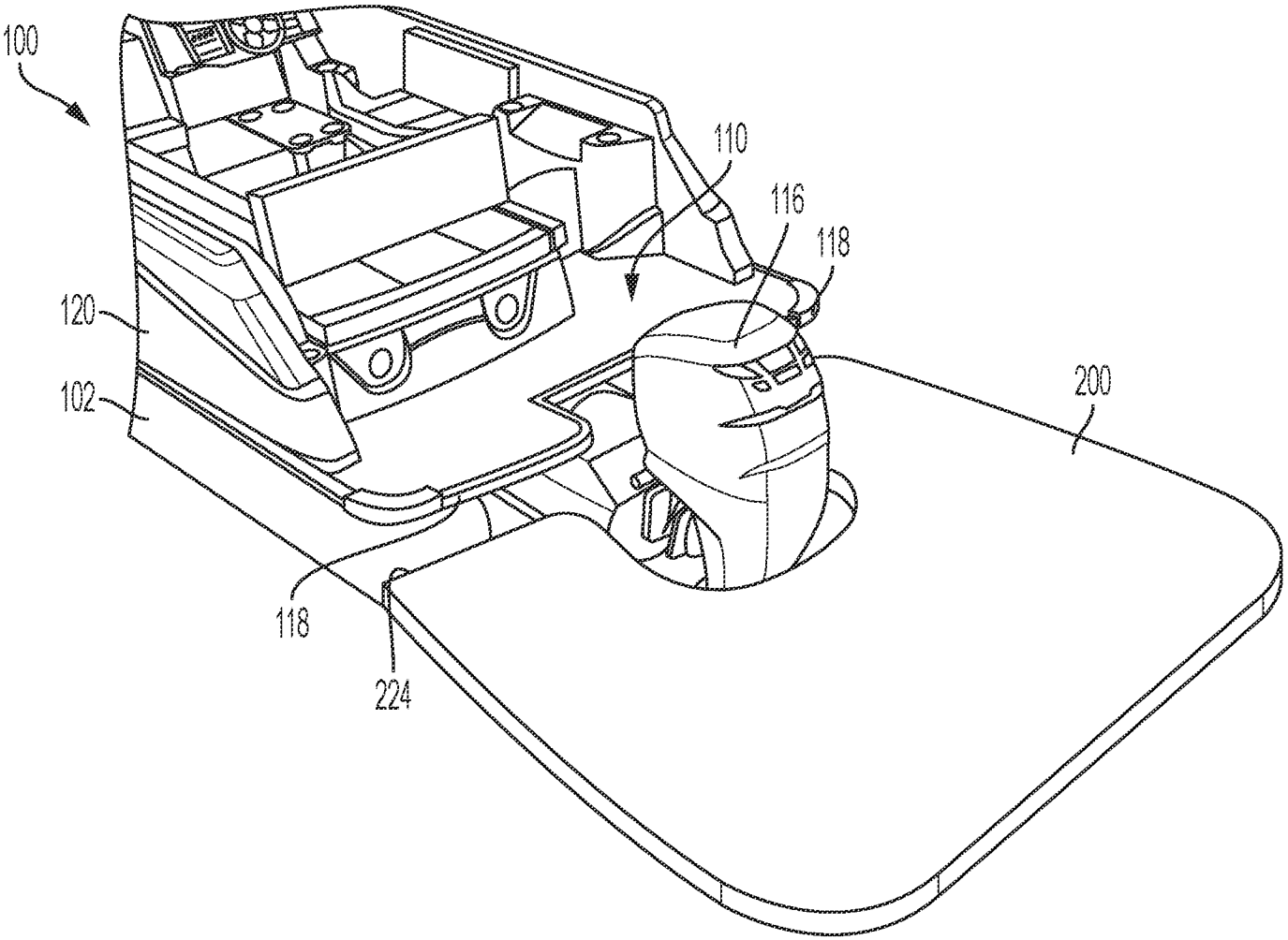
FIG. 8 shows a boat equipped with an inflatable mat according to another preferred embodiment of the invention.
Figure 9:
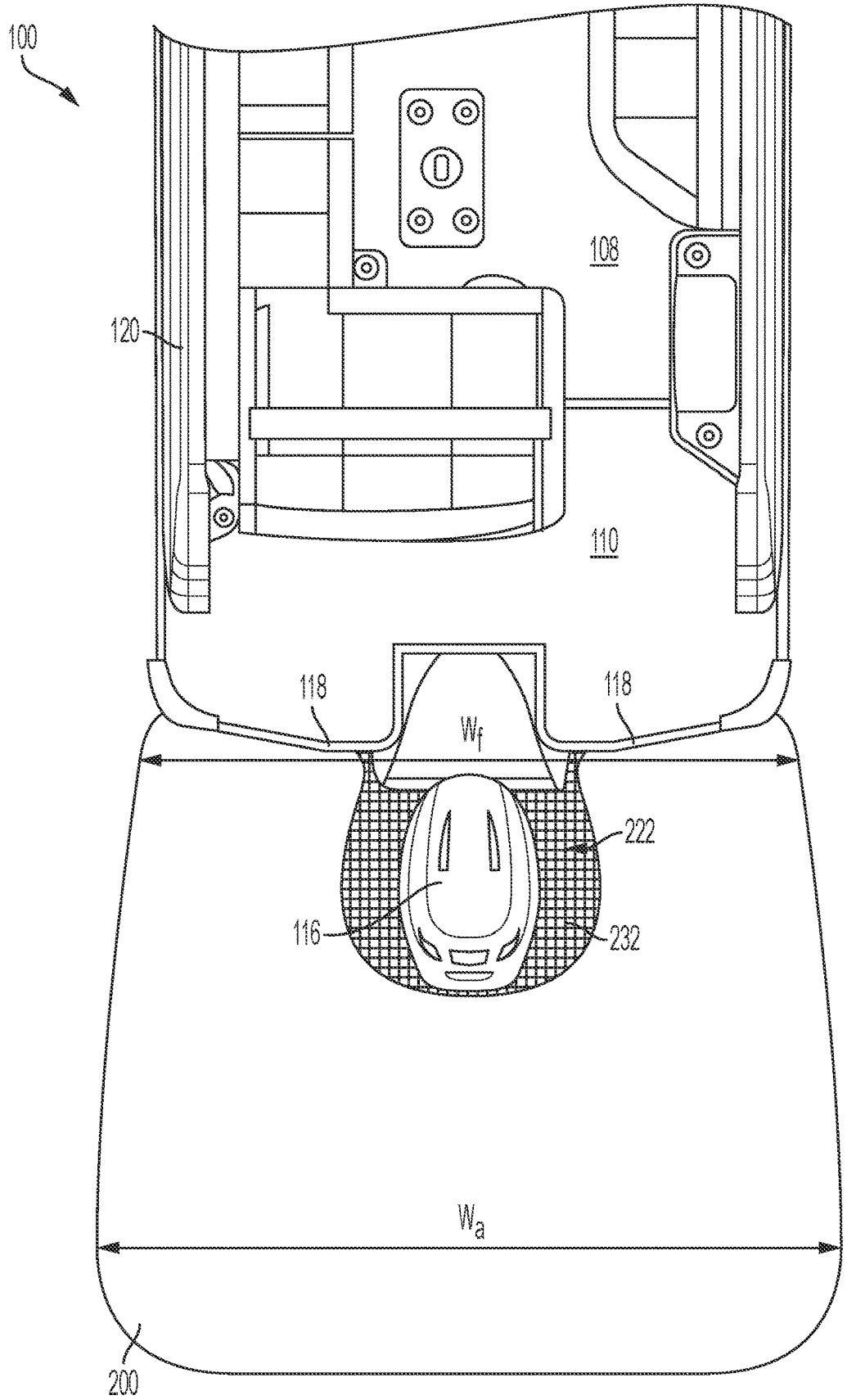
FIG. 9 is a top view of the boat and inflatable mat shown in FIG. 8.
Figure 10:
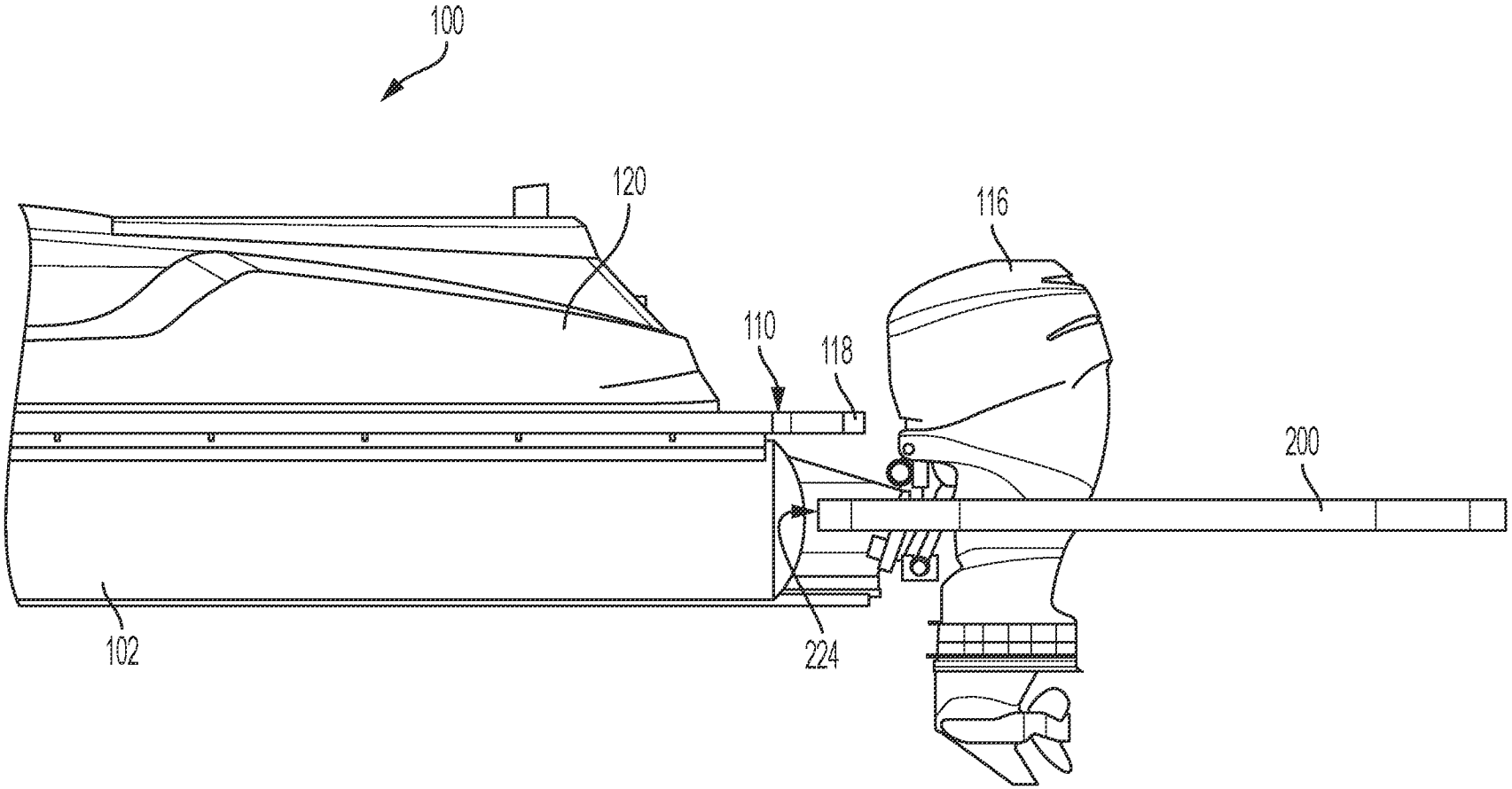
FIG. 10 is a port side view of the boat and inflatable mat shown in FIG. 8.

FIGS. 8-10 show an embodiment of the invention in which the inflatable mat 200 is attached to the stern of the boat 100. The boat 100 of this embodiment is propelled by an outboard motor 116. In this embodiment, the inflatable mat 200 has a U-shape and includes a cut-out 222 that is sized to accommodate the outboard motor 116 therein, allowing front edges 224 of the inflatable mat 200 to be located proximate to (or in this embodiment under) the aft surfaces 118 of the stern deck 110 on both the port and starboard sides of the outboard motor 116. The cut-out 222 is also preferably sized to allow the outboard motor 116 to rotate, as turning the steering wheel, even when the motor is off, may cause the outboard motor 116 to rotate. The forward edges of the inflatable mat 200 located under aft surfaces 118 of the stern deck 110 are each attached to the boat 100 using a connecting sheet 210 as discussed above.

A motor connecting sheet 232 may be added between the outboard motor 116 and the inflatable mat 200 to prevent objects or persons from falling between the inflatable mat 200 and the outboard motor 116. Preferably, this motor connecting sheet 232 is flexible and sized to allow the outboard motor 116 to rotate. The motor connecting sheet 232 may be connected to the inflatable mat 200, boat 100, and outboard motor 116 using any suitable method including those discussed above for the connecting sheet 210. The motor connecting sheet 232 may be made from materials and configured like the connecting sheet 210 as discussed above and may also be, for example, a mesh-like material. A benefit of the inflatable mat 200 located around the outboard motor 116 is that it helps keep individuals away from the outboard motor 116 and the propeller.

Figure 11:
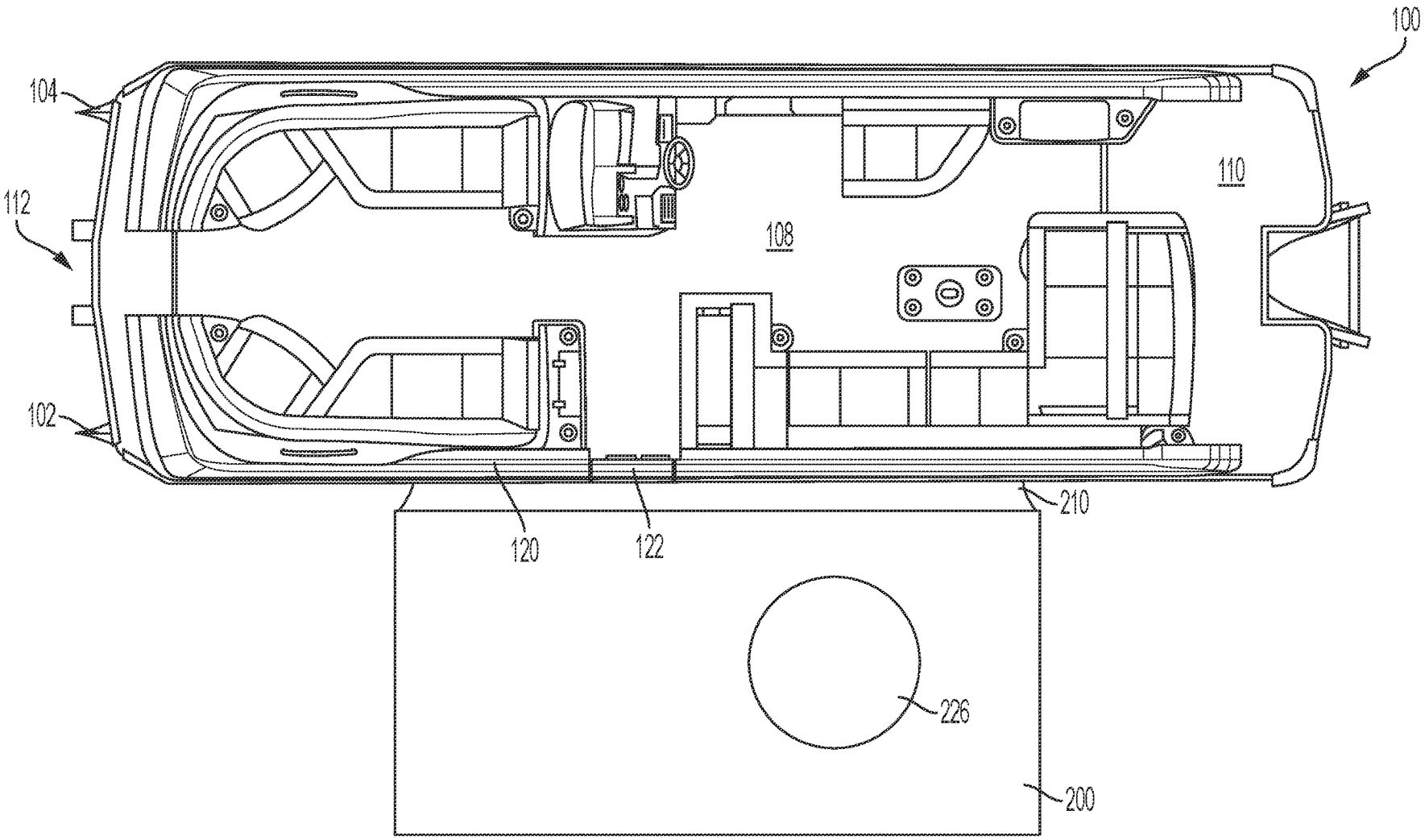
FIG. 11 is a top view of the boat shown in FIG. 5 with an inflatable mat having an alternate shape.
Figure 12:
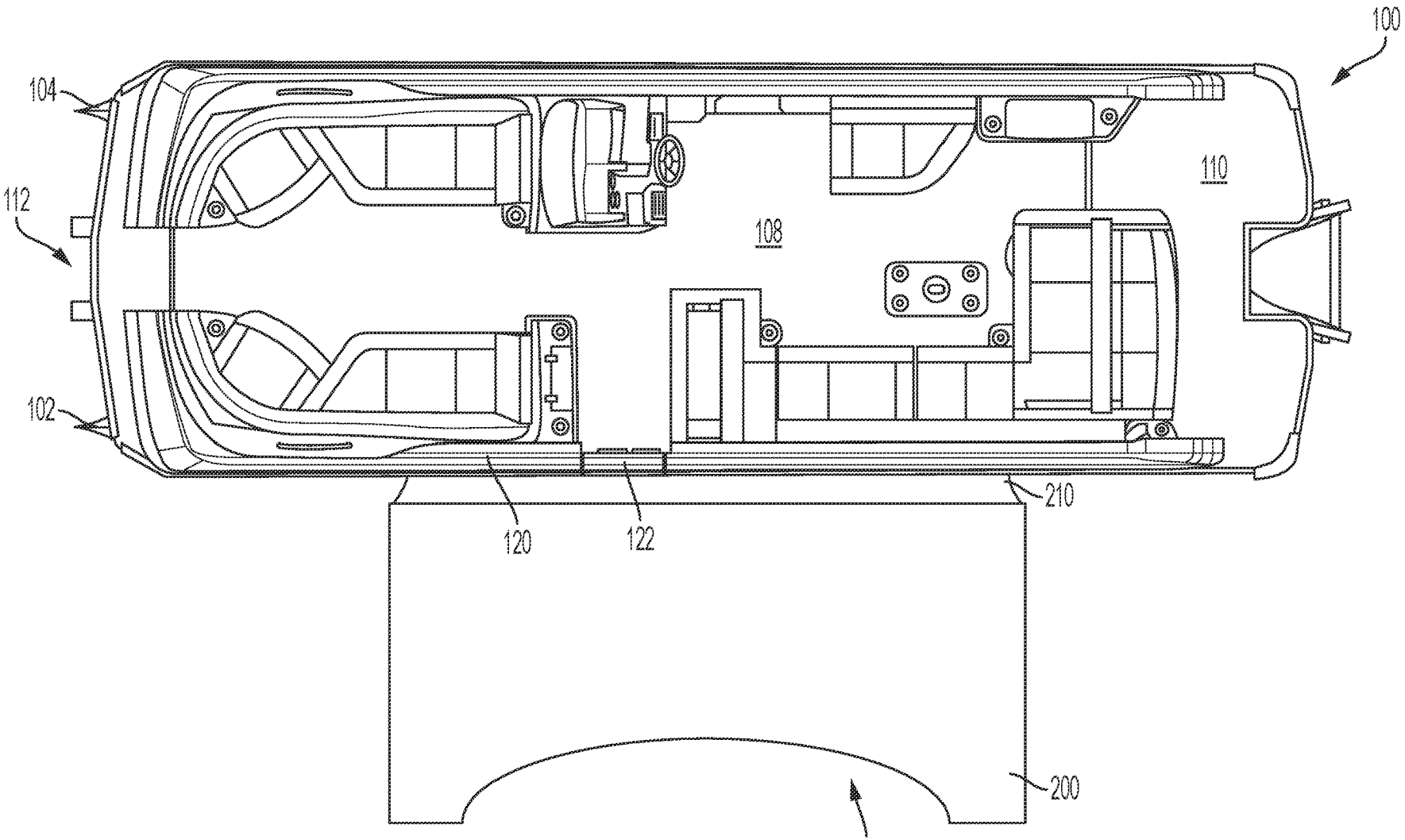
FIG. 12 is a top view of the boat shown in FIG. 5 with an inflatable mat having another alternate shape.

In FIGS. 1-3 and 5-7, the inflatable mat 200 has a rectangular shape when viewed from above (e.g., the top surface of the inflatable mat 200 has a rectangular shape), but any suitable shape may be used. For example, in FIGS. 8-10, the inflatable mat 200 has a trapezoidal shape with a forward width $W_f$ of the inflatable mat 200 being less than an aft width $W_a$ of the inflatable mat 200. Other suitable shapes include kidney-shaped inflatable mats 200 or inflatable mats 200 having a circular cut-out 226 (see FIG. 11) or semi-circular cut-out 228 (see FIG. 12). The inflatable mat 200 has an outer perimeter. The cut-out, such as the circular cut-out 226 shown in FIG. 11, may be formed within the outer perimeter of the inflatable mat 200. Also, the cut-out, such as the semi-circular cut-out 228 shown in FIG. 12, may be located in the outer perimeter of the inflatable mat 200. The semi-circular cut-out 228 is shown in FIG. 12 on the outboard (port) edge of the inflatable mat 200, but it may be located along other edges such as the forward edge or aft edge.

Such shapes or cut-outs 226, 228 enable the inflatable mat 200 to function as a swim-up table on which food or various types of beverages could be served. Features, such as cup holders, for example, may be formed in the inflatable mat 200 proximate the edge of the cut-outs 226, 228 to facilitate holding serving dishes, containers, bottles, cans, and the like. In such a configuration, handholds 234 may be preferably located on the side of the inflatable mat 200 in the cut-outs 226, 228 to help individuals stay next to the inflatable mat 200, or even seats 240 could be integrated with the inflatable mat 200 to allow individuals to sit, partially submerged, next to the inflatable mat 200.

Figure 13:
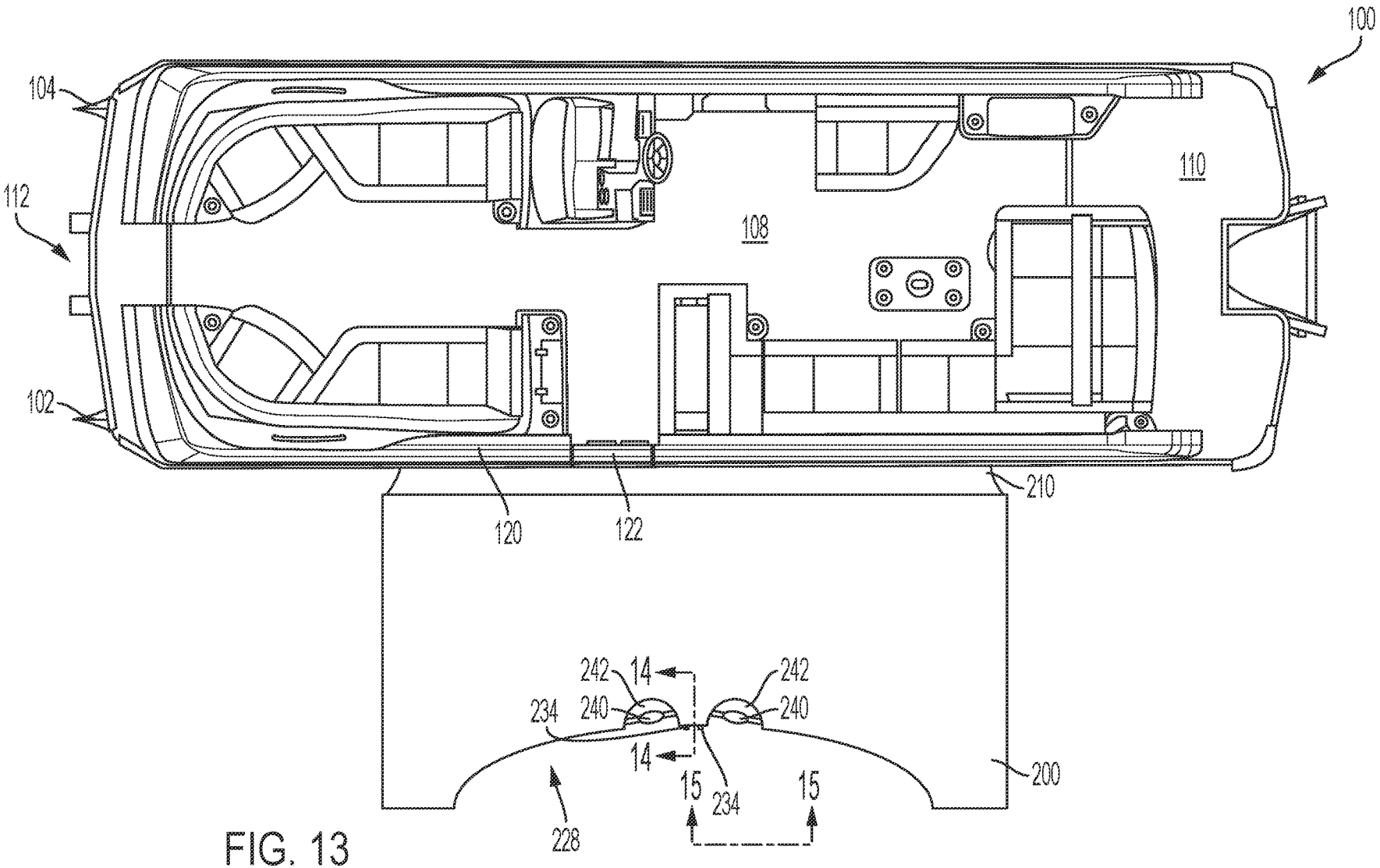
FIG. 13 is a top view of the boat shown in FIG. 5 with an inflatable mat having a further alternate shape.
Figure 14:
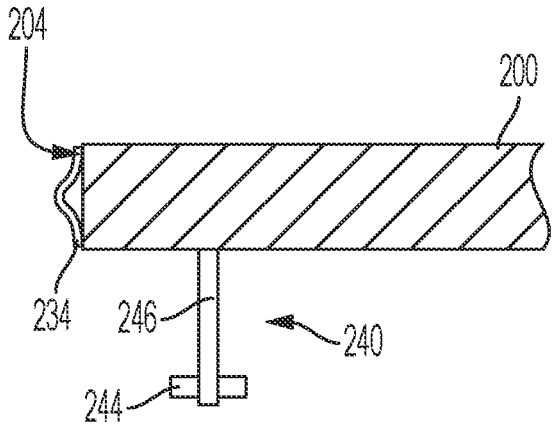
FIG. 14 is a cross-section view of the inflatable mat shown in FIG. 13 taken along line 14-14 in FIG. 13.
Figure 15:
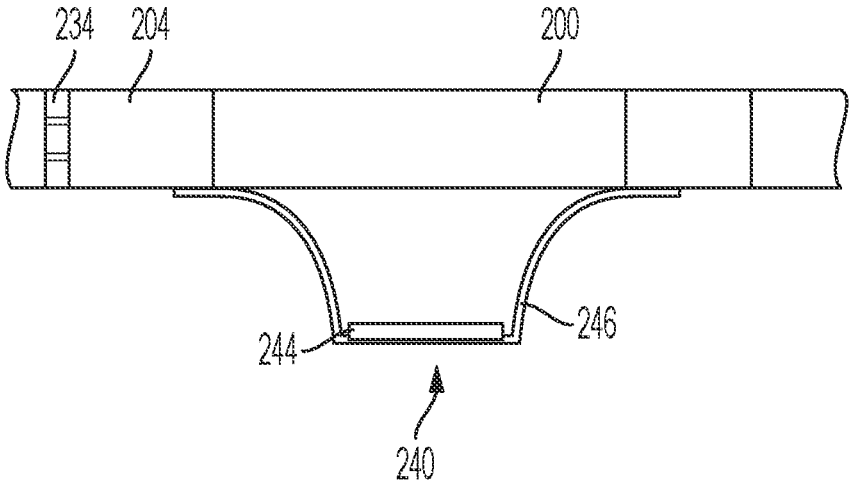
FIG. 15 is a detail view of the inflatable mat shown in FIG. 13 as viewed from line 15-15 in FIG. 13.

Examples of handholds 234 and seats 240 are shown in FIG. 13. The inflatable mat 200 shown in FIG. 13 includes the semi-circular cut-out 228. A plurality of handholds 234 are attached to a lateral side 204 of the inflatable mat 200. The handhold 234 may be attached to any suitable surface of the inflatable mat 200, including the top surface and the bottom surface of the inflatable mat 200 proximate the edge of the inflatable mat 200. FIG. 14 is a cross-sectional view of the inflatable mat 200 shown in FIG. 13 taken along line 14-14 in FIG. 13, and FIG. 15 is a detail view of the inflatable mat 200 shown in FIG. 13 viewed from line 15-15 in FIG. 13. An example of a handhold 234 is shown in FIGS. 14 and 15. In this embodiment, the handhold 234 is a strap made from a material suitable for the marine environment, such as nylon, that is welded or sewn to the lateral side 204 of the inflatable mat 200. The handhold 234 has a width that is suitable to be comfortably grasped by the hand of a user. The handhold 234 has a length that is longer than the lateral side 204 of the inflatable mat 200 allowing the handhold 234 to have a curve shape and permitting a gap between the strap of the handhold 234 and the lateral side 204 of the inflatable mat 200. The gap is preferably sized in both height and width to comfortably fit a hand between the handhold 234 and the lateral side 204 of the inflatable mat 200.

An example of a seat 240 is shown in FIGS. 13-15. Additional cut-outs, herein seat cut-outs 242, are formed in the inflatable mat 200 adjacent to the semi-circular cut-out 228. The seat cut-outs 242 of this embodiment are semi-circular, but they may have any suitable shape. The seat 240 of this embodiment includes a seat bottom 244 located within the seat cut-outs 242 as viewed from above. The seat bottom 244 may have any suitable shape to support the buttocks of a user. In this embodiment, the seat bottom 244 has an oval shape. The seat bottom 244 may be made from any suitable material and is preferably a material with an appropriate thickness to support the user; such materials may include, for example, foam suitable for the marine environment. The seat bottom 244 of this embodiment is connected to the inflatable mat 200 by a seat strap 246. The underside of the seat bottom 244 is attached to the seat strap 246, and the seat strap 246 is attached to the underside of the inflatable mat 200 on either side of the seat cut-outs 242. Any suitable means, including welding or sewing, for example, may be used to attach the seat strap 246 to the seat bottom 244 and the inflatable mat 200. As with the handhold 234, the seat strap 246 may be attached to other portions of the inflatable mat 200 including the lateral side 204, for example. The seat strap 246 preferably has a length that allows the seat bottom 244 to be located a comfortable distance below the bottom surface of the inflatable mat 200.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A water mat system comprising:

a buoyant water mat having a connection side capable of being positioned proximate a boat;

a flexible sheet capable of being positioned between the water mat and the boat, the flexible sheet being connected to the connection side of the water mat and extending along the connection side of the water mat; and at least one linkage connected to the connection side of the water mat and configured to connect the water mat with the boat.

2. The water mat system according to claim 1, wherein the water mat is an inflatable mat.

3. The water mat system according to claim 1, wherein the flexible sheet is connected to the water mat by a plurality of detachable links.

4. A boat comprising the water mat system according to claim 1, wherein the flexible sheet is positioned between the water mat and the boat and the at least one linkage connects the connection side of the water mat to the boat.

5. A pontoon boat comprising:

a port-side pontoon;

a starboard-side pontoon;

a deck supported by the port-side pontoon and the starboard-side pontoon, the deck having an underside; and the water mat system according to claim 1, wherein the flexible sheet is positioned between the water mat and the pontoon boat and the at least one linkage connects the connection side of the water mat to the pontoon boat.

6. The boat according to claim 5, wherein the at least one linkage is connected to the pontoon boat and the flexible sheet to connect the water mat to the boat.

7. The pontoon boat according to claim 5, wherein the at least one linkage is connected to the underside of the deck.

8. The pontoon boat according to claim 7, further comprising a plurality of cross beams supporting the deck, wherein the at least one linkage is connected to at least one of the cross beams.

9. A boat comprising:

a port side;

a starboard side;

a bow;

a stern; and a buoyant water mat connected to the boat along an inboard side of the water mat, the water mat having (i) a top surface, (ii) a bottom surface, (iii) an outer lateral surface, the outer lateral surface forming an outer perimeter of the water mat, and (iv) a cut-out formed in the outer perimeter of the water mat on an outboard side of the water mat.

10. The boat according to claim 9, wherein the water mat is an inflatable mat.

11. The boat according to claim 9, wherein the water mat includes plurality of handholds connected to the water mat proximate the cut-out.

12. The boat according to claim 9, wherein the water mat includes at least one cup holder formed in the water mat proximate an edge of the cut-out.

13. The boat according to claim 9, further comprising:

a port-side pontoon;

a starboard-side pontoon;

a deck supported by the port-side pontoon and the starboard-side pontoon; and a deck support assembly including a plurality of cross beams supporting the deck.

14. The boat according to claim 13, wherein the water mat is connected to at least one of the port-side pontoon, the starboard-side pontoon, an underside of the deck, and the deck support assembly.

15. A boat comprising:

a port side;

a starboard side;

a bow;

a stern; and a buoyant water mat connected to the boat, the water mat having (i) a top surface, (ii) a bottom surface, (iii) an outer lateral surface, the outer lateral surface forming an outer perimeter of the water mat, and (iv) an inner lateral surface defining a cut-out, the cut-out being formed within the outer perimeter of the water mat.

16. The boat according to claim 15, wherein the water mat is an inflatable mat.

17. The boat according to claim 15, wherein the water mat includes a plurality of handholds connected to the water mat proximate the cut-out.

18. The boat according to claim 15, wherein the water mat includes at least one cup holder formed in the water mat proximate an edge of the cut-out.

19. The boat according to claim 15, further comprising:

a port-side pontoon;

a starboard-side pontoon;

a deck supported by the port-side pontoon and the starboard-side pontoon; and a deck support assembly including a plurality of cross beams supporting the deck.

20. The boat according to claim 19, wherein the water mat is connected to at least one of the port-side pontoon, the starboard-side pontoon, an underside of the deck, and the deck support assembly.

* * * * *